US008736406B2

(12) United States Patent
Hapke et al.

(10) Patent No.: US 8,736,406 B2
(45) Date of Patent: May 27, 2014

(54) LID LOCK WITH MAGNETIC ANTI-TAMPER FEATURE

(75) Inventors: Kenyon A Hapke, Libertyville, IL (US); Joel C Bragg, Waterford, WI (US); Michael K Hintz, Waukesha, WI (US); Randy S McDonald, Sussex, WI (US); Mark R Heckenkamp, Sussex, WI (US); Jonathan H Olson, Sussex, WI (US); Adrian J. Tengler, New Berlin, WI (US); Jarod M Sulik, Elkhorn, WI (US)

(73) Assignee: Illinois Tool Works Inc., Glenview, IL (US)

( * ) Notice: Subject to any disclaimer, the term of this patent is extended or adjusted under 35 U.S.C. 154(b) by 107 days.

(21) Appl. No.: 13/580,748

(22) PCT Filed: Feb. 25, 2011

(86) PCT No.: PCT/US2011/026199

§ 371 (c)(1),
(2), (4) Date: Aug. 23, 2012

(87) PCT Pub. No.: WO2011/109235

PCT Pub. Date: Sep. 9, 2011

(65) Prior Publication Data

US 2012/0312594 A1 Dec. 13, 2012

Related U.S. Application Data

(60) Provisional application No. 61/309,208, filed on Mar. 1, 2010.

(51) Int. Cl.

| | |
|---|---|
| ***H01H 9/00*** | (2006.01) |
| ***H01H 9/20*** | (2006.01) |
| ***E05C 17/56*** | (2006.01) |
| ***E05C 19/16*** | (2006.01) |
| ***H01H 36/00*** | (2006.01) |

(52) U.S. Cl.

CPC ..... *H01H 36/00* (2013.01); *H01H 36/0073* (2013.01); *E05C 19/26* (2013.01)

USPC ..... 335/207; 335/205; 335/206; 335/168; 335/170; 335/171; 292/251.5

(58) Field of Classification Search

USPC ..... 335/205–207, 167–171; 292/251.5; 200/43.04, 61.62

See application file for complete search history.

(56) References Cited

U.S. PATENT DOCUMENTS 3,051,805 A * 8/1962 Binford ..... 335/48
3,622,922 A * 11/1971 Mogi ..... 335/2

(Continued)

FOREIGN PATENT DOCUMENTS

| | | | |
|---|---|---|---|
| DE | 4332685 | A1 | 3/1995 |
| DE | 19601228 | A1 | 7/1997 |
| DE | 102006052428 | A1 | 5/2008 |

OTHER PUBLICATIONS

An International Search Report, dated Aug. 17, 2011 in International Application No. PCT/US2011/026199.

*Primary Examiner* — Mohamad Musleh

(74) *Attorney, Agent, or Firm* — Mark W. Croll; Paul F. Donovan

(57) ABSTRACT

A latch for a washing machine or other appliance provides two interengaging elements on a lid and housing each having a magnet oriented for mutual repulsion. Proper repulsion of the magnets is necessary to signal that the lid is properly closed such as may be used to determine if the appliance may be locked and safely operated, for example, in a clothes spinning mode.

21 Claims, 4 Drawing Sheets

(56) References Cited

U.S. PATENT DOCUMENTS

| | | | | |
|---|---|---|---|---|
| 3,729,697 | A * | 4/1973 | Hounsgard | 335/205 |
| 5,062,668 | A | 11/1991 | Onderka et al. | |
| 5,485,733 | A * | 1/1996 | Hoffman | 70/276 |
| 5,520,424 | A | 5/1996 | Hapke et al. | |
| 5,823,017 | A * | 10/1998 | Hapke et al. | 68/12.26 |
| 6,363,755 | B1 | 4/2002 | Hapke et al. | |
| 6,659,516 | B2 * | 12/2003 | Wang et al. | 292/251.5 |
| 7,234,739 | B2 * | 6/2007 | Saitoh et al. | 292/251.5 |
| 7,251,961 | B2 | 8/2007 | Hapke et al. | |
| 7,705,253 | B2 | 4/2010 | Krieger et al. | |
| 7,876,567 | B2 * | 1/2011 | Wang | 361/726 |
| 8,148,653 | B2 | 4/2012 | Sattler et al. | |
| 8,400,240 | B2 * | 3/2013 | Pfeiffer et al. | 335/205 |
| 2004/0134239 | A1 | 7/2004 | Hapke et al. | |
| 2006/0049645 | A1 * | 3/2006 | Drumm | 292/251.5 |
| 2006/0145485 | A1 * | 7/2006 | Hapke | 292/251.5 |
| 2008/0179895 | A1 * | 7/2008 | Lin | 292/116 |
| 2010/0045054 | A1 * | 2/2010 | Holmgren | 292/251.5 |

* cited by examiner

LID LOCK WITH MAGNETIC ANTI-TAMPER FEATURE

CROSS-REFERENCE TO RELATED APPLICATION

This application is based on International Application No. PCT/US2011/026199 filed Feb. 25, 2011 and claims the benefit of U.S. provisional application 61/309,208 filed Mar. 1, 2010.

FIELD OF THE INVENTION

The present invention relates to home appliances such as clothes washing machines and the like and in particular, to a lid locking mechanism that is highly resistant to tampering.

BACKGROUND OF THE INVENTION

The spin cycle of a washing machine removes water centrifugally from wet clothes by spinning the clothes at high speed in a spin basket. In order to reduce the possibility of injury to the user during the spin cycle, it is known to use an electronically actuated lock for holding the washing machine lid in the closed position. U.S. Pat. Nos. 6,363,755; 5,823,017; and 5,520,424, assigned to the present assignee and hereby incorporated by reference, describe several locking mechanisms.

In order to prevent tampering with the lock mechanism, for example, by holding the lid open when the lock is actuated, it is known to provide for lid closure sensing to ensure that the lid is in a proper position before the lock mechanism is engaged. Conventional mechanical lid closure switches can often be defeated by wedging the switch open for example with the end of a pencil or the like. U.S. Pat. No 7,251,961, assigned to the assignee of the present invention and hereby incorporated by reference, describes a lid sensor using a magnet and electrical reed switch to detect lid closure. The use of a magnetic actuator reduces the possibility of casual tampering.

SUMMARY OF THE INVENTION

The present invention provides a magnetic anti-tamper feature with even greater resistance to tampering by employing a mechanism that requires a particular polarity of magnetic field and a magnet strength and proximity that is not easily duplicated.

Specifically, the present invention provides an appliance latch having a bolt and a corresponding latch for receiving the bolt, the bolt and latch positionable on an appliance door and appliance frame. A first magnet is positioned on the bolt and a second magnet is positioned on a movable element within the latch to be moved in response to proximity of the first magnet when the bolt is received by the latch. An electric switch actuatable with movement of the movable element, provides a switch signal indicating proper engagement of the bolt and latch for locking. A lock element holds the bolt engaged with the latch when the bolt is properly engaged with the latch and a lock signal has been received by the lock element allowing release of the bolt from engagement with the latch when a release signal has been received by the lock element.

It is thus a feature of at least one embodiment of the invention to prevent defeat of a lid locking system, intended to protect the consumer from injury, by providing a sophisticated interlock system requiring multiple correctly positioned magnets.

The polarity of the first and second magnet may be such as to repel the movable element from the bolt when the bolt is properly engaged within the latch.

It is thus a feature of at least one embodiment of the invention to prevent defeat of the present system by materials that exhibit magnetic attraction such as steel.

The movable element may actuate a switch controlling the lock switch signal.

It is thus a feature of at least one embodiment of the invention to provide a signal to an appliance controller affirming proper closure of the lid for locking, such as may be used to trigger a locking action and to confirm proper locking of the lid.

The lock element may include a trap moved from a first bolt-releasing position to a second, bolt-retaining position by the engagement of the bolt with the latch, and a blocking element receivable by the trap when the trap is in the second, bolt-retaining position to block movement of the trap to the first of both releasing positions. An electric actuator communicating with the blocking element may move the blocking element into receipt by the trap when the lock signal has been received by the lock element and remove the blocking element from receipt by the trap when the release signal has been received by the lock element.

It is thus a feature of at least one embodiment of the invention to provide a latch in which a lid switch signal based on the position of the bolt also indicates that the bolt may be locked in position by an electric actuator.

The electric actuator may be a solenoid and bistable mechanism moving the blocking element between receipt by the trap and removal from the trap with successive energizing of the solenoid and wherein the lock signal is a first energizing and the unlock signal is a second energizing of the solenoid.

It is thus a feature of at least one embodiment of the invention to provide a locking system with reduced energy consumption and which is not defeated by momentary power loss.

The trap may be a sliding member and the movable element holding the second magnet may be slidably held by the trap.

It is thus a feature of at least one embodiment of the invention to provide a compact assembly that ensures good proximity of the movable element and magnet to the bolt being received by the trap.

The bolt may be received in the latch along an axis and may travel perpendicularly to the axis as it is received within the latch. The bolt may include a spring urging the bolt in a first direction perpendicular to the axis. The first direction may be the same as a direction of movement of the trap toward the bolt retaining position.

It is thus a feature of at least one embodiment of the invention to employ the bolt and a spring to position the trap for retaining and holding the bolt.

The bolt may be mounted for travel perpendicular to the axis and a cam surface of the latch may move the bolt to push the trap toward the bolt retaining position.

It is thus a feature of at least one embodiment of the invention to position the trap via a cam surface acting on the bolt The engagement of the bolt with the trap may activate a switch indicating closing of the lid.

It is thus a feature of at least one embodiment of the invention to eliminate the need for a separate lid switch operator.

Motion of the bolt to disengage from the latch when the blocking element is received by the trap may cause an abutting of the blocking element against a frangible portion of the trap which when broken prevents activation of the locking switch.

It is thus a feature of at least one embodiment of the invention to detect damage to the latch by forcible opening that might prevent future locking.

The frangible portion of the trap may support a spring element away from an opening into which the blocking element may be received such that removal of the frangible element causes the spring element to occlude the opening.

It is thus a feature of at least one embodiment of the invention to provide a simple method of signaling damaged by defeating the blocking element and thus deactivating the lock signal.

The appliance may be a washing machine having a spin basket operated by a motor and further including an appliance control receiving a signal generated at least in part from the locking switch to block power from the motor when proper engagement of the bolt and latch is not indicated by the locking switch.

It is thus a feature of at least one embodiment of the invention to provide an improved latch for washing machines.

Other features and advantages of the invention will become apparent to those skilled in the art upon review of the following detailed description, claims and drawings in which like numerals are used to designate like features.

Figure 1:
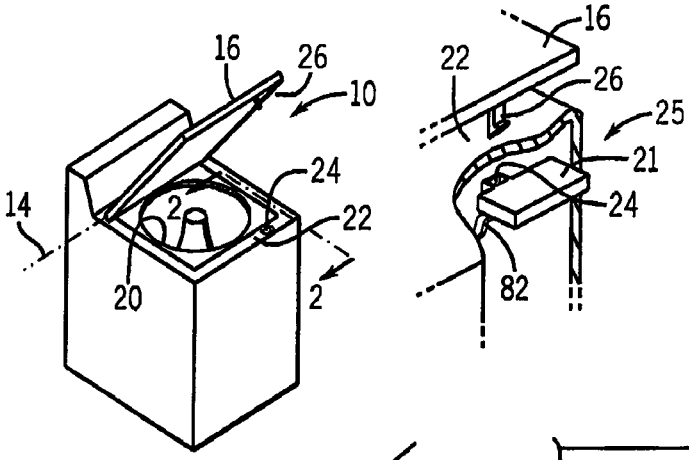
FIG. 1 is a perspective view and inset detail of a top loading washing machine suitable for use with the present invention showing a strike aperture positioned near the front of an upwardly opening lid and showing a downwardly extending bolt for engaging a strike when the lid is closed.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENT

Referring now to FIG. 1, a top loading washing machine 10 suitable for use with the present invention includes a lid 12 opening upward about a horizontal lid hinge axis 14. The lid hinge axis 14 is positioned near the top rear edge of the washing machine 10 so that a rear edge 16 of the lid 12 may raise and lower to expose and cover an opening 20 through which clothing may be inserted into the spin basket. A front-loading washing machine (not shown) is also suitable for use with the present invention as will be apparent to those of ordinary skill in the art from the following description with an appropriate adjustment of the orientation.

A horizontal surface of the top 22 of the washing machine 10, at the periphery of the opening 20, may support a strike aperture 24 form in a housing 21 of a latch 25 fastened to the underside of the top 22. The strike aperture 24 opens upward to receive a downwardly extending bolt 26 attached to an underside of the lid 12. Both the strike aperture 24 and the bolt 26 are offset parallel to the axis 14 and offset from a center of the front edge 16 so as to minimize interference with loading and unloading the washing machine 10.

Figure 2:
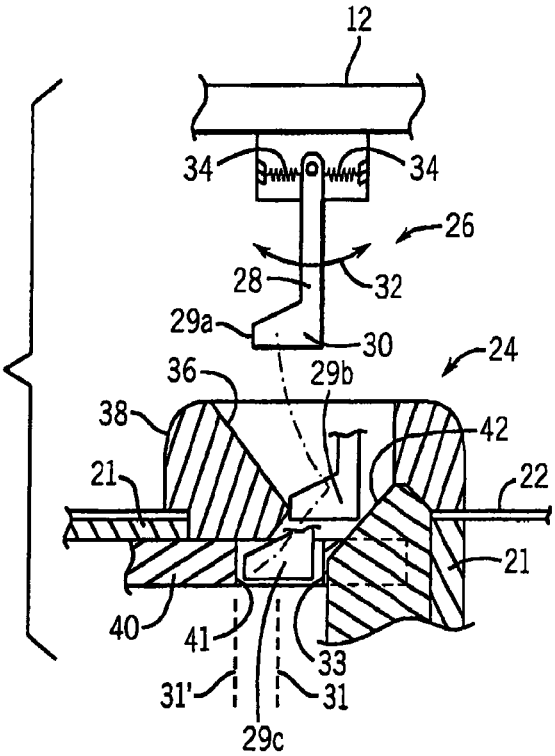
FIG. 2 is a fragmentary cross-section along line 2-2 of FIG. 1 showing a floating mounting of the bolt allowing close tolerance interaction between the bolt and strike to move a trap element to a retaining and locking position.

Referring now to FIG. 2, the bolt 26 may include a downwardly extending arm 28 terminating in a hook portion 30 extending leftward from the arm 28, as shown in FIG. 2, generally toward a user of the washing machine 10. The upper end of the arm 28 may be mounted to the lid 12 to pivot left and right as indicated by arrows 32 with respect to the lid 12 under restoring spring forces indicated schematically by springs 34. In this way, the left and right surfaces of the hook portion 30 may translate as may be necessary to accommodate positional tolerances in the manufacture of the washing machine 10 and wear of the washing machine 10 and to provide movement of a trap to be described.

As the lid is closed, the hook portion 30 moves toward the strike aperture 24 and is guided rightward by a right facing first sloping edge 36 of an aperture bezel 38 defining the strike aperture 24. The aperture bezel moves the hook portion 30 to position 29*b* with a left edge of the bolt 26 aligned at first position 31 with the right edge of an un-retracted trap 40 (shown in a retracted position in FIG. 2). The bolt 26 is then urged left by a left facing second sloping edge 42 so as to push the trap 40 leftward against a restoring spring (not shown in FIG. 2) so that a left edge of an opening in the trap 40 is moved to position 31' as hook portion 30 passes to position 29*c*.

A following surface 33 of the trap 40, when the trap is retracted with the bolt 26 in position 29*c*, prevents rightward movement of the hook portion 30 trapping it beneath a ledge on the underside of the sloping edge 36. This serpentine path defined by sloping edges 36 and 42 ensures that the left edge of the bolt 26 abuts the left edge 41 of the trap 40 in close proximity despite tolerance variations between the lid 12 and the top 22 and allows the bolt 26 to move the trap 40 to the retracted position needed for locking as will be described.

Figure 3:
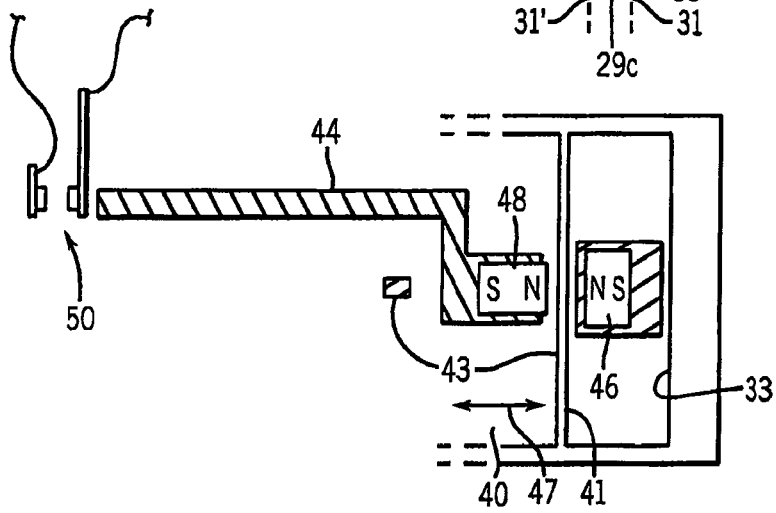
FIG. 3 is a top plan cross-sectional view of a trap engaging the bolt when the bolt is received by the strike and showing the position of magnets within the bolt and held by an anti-tamper slider within the trap, the former movable within the trap under the influence of magnetic repulsion.

Referring now to FIG. 3, the trap 40 may hold within it an anti-tamper slider 44 movable independently of the trap 40 in a left-right direction 47 within a range dictated by stop surfaces 43. The hook portion 30 of the bolt 26 may contain an embedded magnet 46 having an orientation to oppose and repel a corresponding magnet 48 in a right end of the anti-tamper slider 44 proximate to the left edge 41 of the opening of the sliding trap 40. The force of magnetic repulsion as the bolt 26 slides into the left edge 41 moves the anti-tamper slider 44 left to close a contact set 50 mounted on a stationary point with respect to the sliding of the trap 40 and used to indicate the presence of the bolt 26 at position 29*c* and hence closure of the lid 12. The anti-tamper slider 44 thereby distinguishes the bolt 26 from a tool that may be used to tamper with the trap 40 even if the tool is ferromagnetic.

The anti-tamper slider is biased rightward by the contact set 50 and moves independently of motion of the trap 40 throughout most of the range of travel of the trap 40. The stop surfaces 43 ensure some movement of the anti-tamper slider 44 with movement of the trap 40 that prevents it from sticking, but this movement is insufficient to activate a contact set 50.

Figure 4:
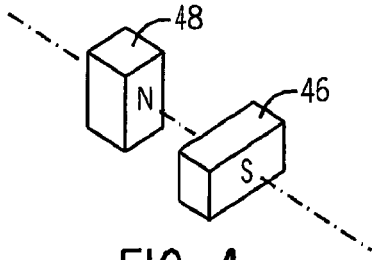
FIG. 4 is a perspective view showing the orientation of the magnets in the bolt and anti-tamper slider providing improved accommodation of positioning errors.

Referring now to FIG. 4, the magnets 46 and 48 may be rectangular prisms having their greatest dimension extending relative to each other at a perpendicular angle to provide improved immunity against slight misalignment of the magnets in a lateral direction (parallel to the hinge axis) and up and down along the direction of engagement of the bolt 26. Generally, a strong and concentrated magnetic field of the correct polarity is necessary to activate the anti-tamper contact set 50 which prevents operation of the washing machine if the bolt 26 is not in its correct position 29*c*.

Figure 5:
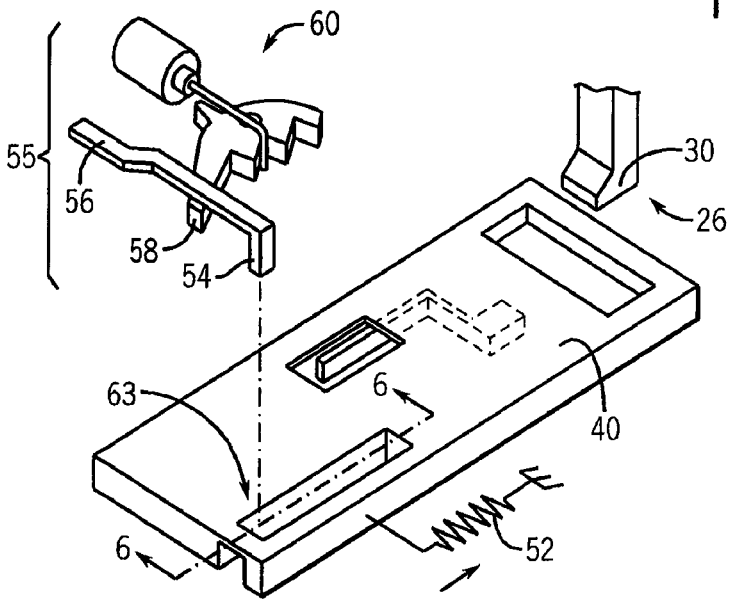
FIG. 5 is a simplified perspective view of the trap engaging the bolt showing the positioning of the anti-tamper slider and a breakaway aperture at the front of the trap and showing a bi-stable actuator above the trap for controlling a blocking element descending to block movement of the trap.

Referring now to FIG. 5, the sliding trap 40 is normally biased rightward by a biasing spring showed schematically as spring 52 to receive hook portion 30 when hook portion 30 is moved into position 29*b* shown in FIG. 2 then to hold the hook portion 30 against upward motion. The trap 40 includes an aperture 63 at its left edge. When the trap 40 is retracted leftward, capturing the hook portion 30, the aperture 63 aligns with a blocking element 54 which may descend into the aperture 63 from an actuator mechanism 55 positioned above the trap 40. In this configuration, rightward movement of the trap 40 is stopped by interference between a left surface of the blocking element 54 abutting a blockade surface 53 forming a left wall of the aperture 63. Thus, the trap 40 acts as a trap to hold the bolt 26 in position when the blocking element 54 acts as a blocking element to the trap 40.

Figure 6A:
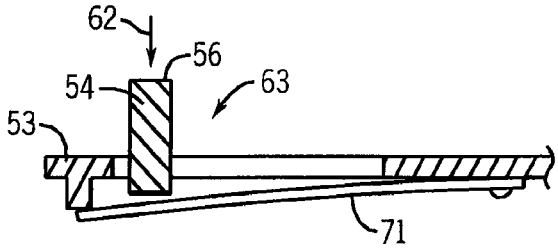
FIGS. 6*a* and 6*b* are cross-sectional views taken along line 6-6 showing engagement of a blocking element within the aperture of the trap and showing a blocking of that engagement when aperture integrity has been compromised through forcing open of the latch.
Figure 9:
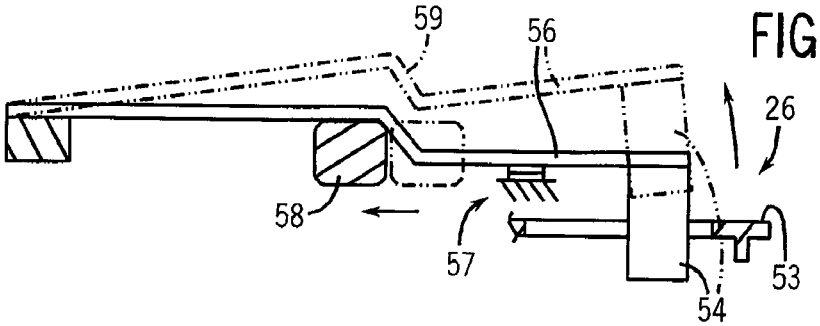
FIG. 9 is a side elevational view of the blocking element and lock switch of FIGS. 5, 7*a* and 7*b;*

Referring now to FIGS. 5, 6*a* and 9, the blocking element 54 may be moved downward under the influence of a flexible leaf spring 56. The flexible leaf spring 56 holding one of a pair of contacts of a lock switch 57 indicating proper locking of the latch 25 when the blocking element 54 is lowered and the contacts connect closing the lock switch 57. At this time, the blocking element 54 may only be disengaged by action of a bistable solenoid mechanism 60 (shown schematically in FIG. 5 and described below) providing a wedge element 58 that may lift the leaf spring 56 to raise the blocking element 54 by contacting a sloped portion 59 of the leaf spring 56.

Figure 6B:
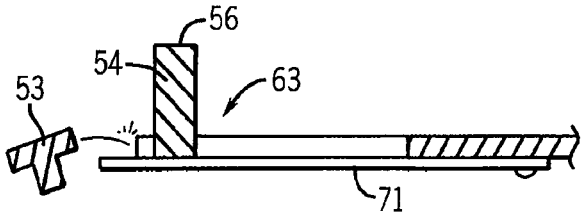

Referring again to FIG. 5, the blockade surface 53 may be formed by a thin member that can break away as shown in FIG. 6*b* if the lock is forcibly opened by pressing rightward on the trap 40 when the blocking element 54 has descended, such as may occur from a forcible extraction of the bolt 26. When the blockade surface 53 is broken away, a leaf spring 71 positioned on the under surface of the trap 40 is free to move upward and carries with it the blocking element 54, opening contacts on the lock switch throughout the range of travel of the trap 40.

Figure 7A:
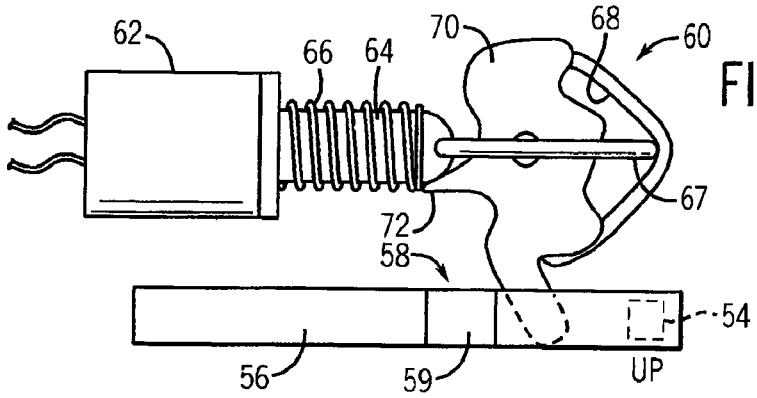
FIG. 7*a* is a top plan view of the bi-stable actuator of FIG. 5 in a first state removing the blocking element from engagement with the trap.
Figure 7B:
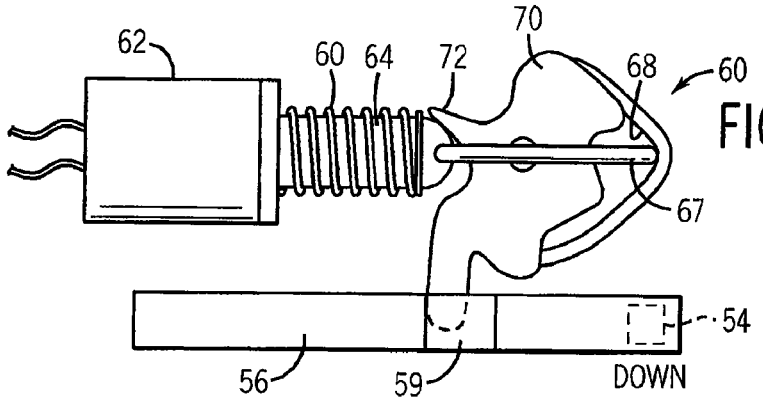
FIG. 7*b* is a figure similar to that of FIG. 7*a* showing the bi-stable actuator in a second state engaging the blocking element with the trap to prevent the movement of the trap.

Referring now to FIGS. 9, 7*a* and 7*b*, the bi-stable mechanism may include an electrical solenoid 62 having a plunger 64 pulled into the solenoid when the solenoid is actuated. The plunger 64 may be surrounded by a helical compression spring 66 that extends the plunger 64 from the solenoid 62 when the solenoid 62 is not actuated. A distal end of the plunger 64 may connect to a pivoting hook 67 guided into alignment with an axis of the plunger 64 when the plunger is fully extended by means of an angled track 68 sloping to an apex spaced from the solenoid 62 and aligned with an axis of the plunger 64.

When the solenoid 62 is actuated, the hook 67 is drawn inward and contacts a serrated front surface of a rocking element 70 so that successive energizing of the solenoid 62 releasing and then pulling in the plunger 64 causes the rocking element 70 to rock between extremes depicted in FIGS. 7*a* and 7*b*. A serrated surface of the rocking element 70 guides the hook 67 to pull on opposite sides of the rocking element 70 as it moved from the resting position at the apex of the track 68, causing this bi-stable motion.

The rotated extreme, shown in FIG. 7*b* in a fully clockwise direction, normally provides a locked state for the trap 40, while the rotated extreme of FIG. 7*a* in a fully counterclockwise direction normally provides an unlocked state of the trap 40.

Referring again to FIG. 9, the unlocked state is associated with the wedge element 58 being positioned beneath a sloped portion 59 of the leaf spring 56 to raise the blocking element 54 from engagement with the aperture of the trap 40 (shown in FIG. 5). In contrast, the locked state is associated with the wedge element 58 being removed from the sloped portion 59 of the leaf spring 56 allowing the blocking element 54 to descend into the aperture of the trap 40.

Figure 8:
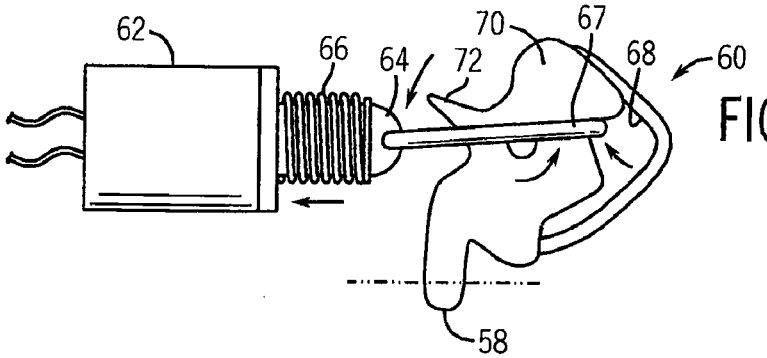
FIG. 8 is a view similar to that of FIGS. 7*a* and 7*b*, with the blocking element and supporting lock switch removed for clarity, showing actuation of the solenoid during movement between the states of FIGS. 7 and 8 such as frees an antivibration tooth for clearance of the solenoid plunger.

Referring now to FIGS. 7*a*, 7*b*, and 8, the rocking element 70 may have an anti-vibration tooth 72 extending leftward therefrom to abut an end of the plunger 64 when the solenoid 62 is not being energized and yet is fully extended by helical springs 66. The anti-vibration tooth 72, which is positioned abutting opposite sides of the extended plunger 64 for the unlocked state of FIG. 7*a* and the locked state of FIG. 7*b*, prevents rotation of the rocking element 70 from vibration alone so long as the solenoid plunger 64 is fully extended. When the solenoid 62 is actuated, however, as shown in FIG. 8, a pulling in of the solenoid plunger 64 allows the anti-vibration tooth 72 to slip past the end of the plunger 64 and rotation of the rocking element 70 to occur.

Figure 10:
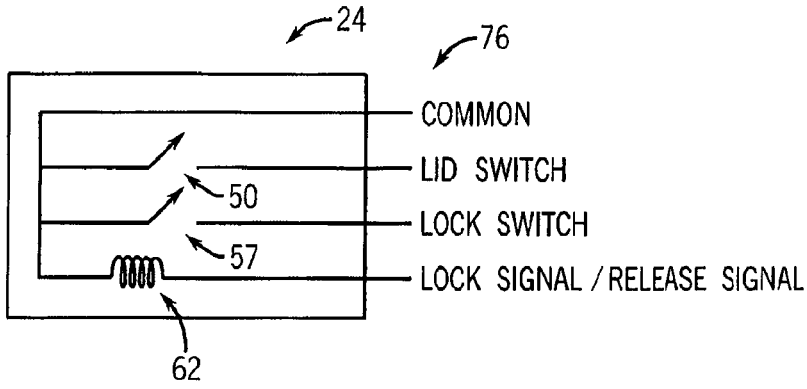
FIG. 10 is a schematic diagram of the interconnection of the solenoid, lock switch and lid switch.

Referring now to FIG. 10, the latch 25 may provide for four conductors 76 that may be connected, for example, by releasable connectors or the like to a cycle timer or other control apparatus on the washing machine 10. One of these conductors 76 provides connection for a common source of voltage that connects to one side of the contact set 50 providing a lid switch whose other side connects to a conductor 76 providing the lid switch signal. The common conductor may also connect to one side of the lock switch 57, the other side of which provides a lock switch signal on conductor 76. Finally, the common conductor may also connect to one side of the solenoid 62, the other side providing a conductor for receiving a lock signal, and a release signal being successive electrical current flows.

Figure 11:
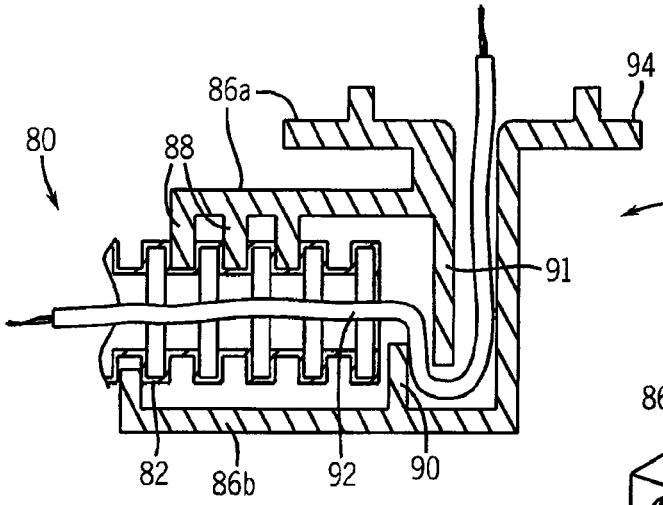
FIG. 11 is a cross-section through a strain relief that may be used in the present invention providing a clamping of electrical wires while redirecting them to a 90° bend.
Figure 12:
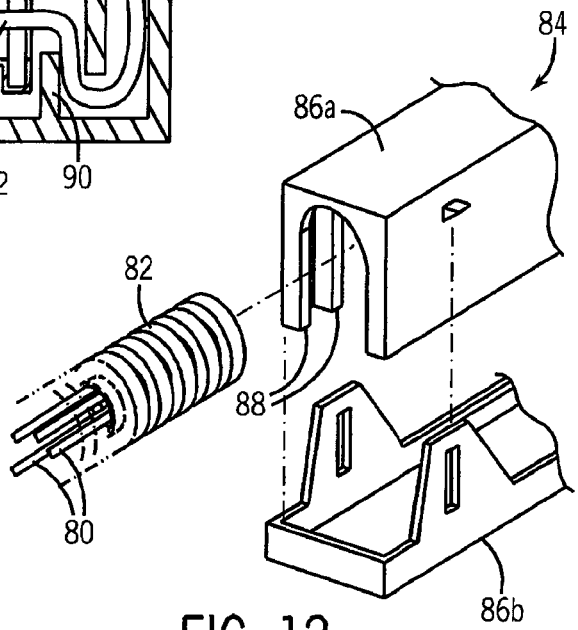
FIG. 12 is a fragmentary, perspective view of the strain relief of FIG. 11 in exploded form.

Referring now to FIGS. 11 and 12, the present invention may also provide a wiring harness 80 exiting a housing holding the above-described mechanism. The wires may be contained inside a so-called split loom tube 82 having a bellows-shaped outer surface. A two-part bushing 84 may provide for a first and second portion 86*a* and 86*b* that snap together to engage the troughs of the split loom tube 82 with correspondingly spaced teeth 88. The second portion 86*b* provides an upwardly extending finger 90 and the first portion provides a downwardly extending finger 91 which bend the internally contained wiring 92 into a serpentine path as the portions 86*a* and 86*b* are brought together. The path exits upward through a bushing 94 at approximately 90° to the axis of the split loom tube 82. In this way a strain relief can be obtained that also provides for a bending of the wires for a 90° entry Certain terminology is used herein for purposes of reference only, and thus is not intended to be limiting. For example, terms such as "upper", "lower", "above", and "below" refer to directions in the drawings to which reference is made. Terms such as "left", "right", "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An appliance latch assembly comprising:

a bolt and a corresponding latch for receiving the bolt, the bolt and latch positionable on an appliance door and appliance frame;

a first magnet positioned on the bolt;

a second magnet positioned on a movable element within the latch to be moved in response to proximity of the first magnet only when the bolt is received within the latch;

an electric switch actuatable with movement of the movable element providing an electric lid switch signal indicating proper engagement of the bolt within the latch for locking; and a lock element adapted to receive an electric lock signal and to respond to the lock signal to hold the bolt engaged with the latch when the bolt is properly engaged within the latch and to permit release of the bolt from engagement with the latch when the electric lock signal is not received by the lock element.

2. The appliance latch assembly of claim 1 wherein a polarity of the first and second magnet is such as to repel the movable element from the bolt when the bolt is properly engaged within the latch.

3. The appliance latch assembly of claim 2 wherein the first and second magnets are rectangular prisms having their greatest dimension extending relative to each other at a perpendicular angle.

4. The appliance latch assembly of claim 1 wherein the movable element actuates the electric switch controlling the lid switch signal.

5. An appliance latch assembly comprising:

a bolt and a corresponding latch for receiving the bolt, the bolt and latch positionable on an appliance door and appliance frame;

a first magnet positioned on the bolt;

a second magnet positioned on a movable element within the latch to be moved in response to proximity of the first magnet when the bolt is received by the latch;

an electric switch actuatable with movement of the movable element providing a lid switch signal indicating proper engagement of the bolt and latch for locking; and a lock element for holding the bolt engaged with the latch when the bolt is properly engaged and a lock signal has been received by the lock element and for allowing release of the bolt from engagement with the latch when an unlock signal has been received by the lock element wherein the lock element includes:

a trap movable from a first bolt-releasing position to a second, bolt-retaining position by the engagement of the bolt with the latch;

a blocking element receivable by the trap when the trap is in the second, bolt-retaining position to block movement of the trap to the first bolt-releasing position; and an electric actuator communicating with the blocking element to move the blocking clement into receipt by the trap when the lock signal has been received by the lock, element and to remove the blocking element from receipt by the trap when the unlock signal has been received by the lock element.

6. The appliance latch assembly of claim 5 wherein the electric actuator is a solenoid and bistable mechanism moving the blocking element between receipt by the trap and removal from the trap with successive energizing of the solenoid and wherein the lock signal is a first energizing and the unlock signal is a second energizing of the solenoid.

7. The appliance latch assembly of claim 5 wherein the trap is a sliding member and the movable element is a slidably held by the trap.

8. The appliance latch assembly of claim 5 wherein the bolt is received in the latch along an axis and may travel perpendicularly to the axis as it is received within the latch.

9. The appliance latch assembly of claim 8 wherein the bolt is pivoted for the travel perpendicular to the axis and includes a spring urging the bolt in a first direction perpendicular to the axis.

10. The appliance latch assembly of claim 9 wherein the first direction is a direction of movement of the trap toward the bolt retaining position.

11. The appliance latch assembly of claim 8 wherein the bolt is mounted for travel perpendicular to the axis and a cam surface of the latch moves the bolt to push the trap toward the bolt retaining position.

12. The appliance latch assembly of claim 5 wherein moving of the blocking element into receipt by the trap activates a lock switch indicating a locking of the lid.

13. The appliance latch assembly of claim 12 further wherein motion of the bolt to disengage the bolt from the latch when the blocking element is received by the trap causes an abutting of the blocking element against a frangible portion of the trap which when broken prevents movement of the blocking element into receipt by the trap.

14. The appliance latch assembly of claim 13 wherein the frangible portion of the trap supports a spring element away from an opening into which the blocking element may be received such that removal of the frangible element causes the spring element to occlude the opening.

15. The appliance latch assembly of claim I wherein the appliance is a washing machine having a spin basket operated by a motor and further including an appliance control receiving a signal generated at least in part from the electric switch to block power from the motor when proper engagement of the bolt and latch is not indicated by the electric switch.

16. A method of detecting tampering with a washing machine latch comprising the steps of:

attaching a bolt and a corresponding latch for receiving the bolt on an appliance door and appliance frame;

positioning a first magnet within the bolt;

inserting the bolt in the latch to repel a second magnet positioned on a movable element within the latch to be moved in response to proximity of the first magnet only when the bolt is received within the latch;

detecting movement of the movable element to providing a lid switch signal indicating proper engagement of the bolt and latch; and capturing the bolt in the latch by means of a lock element responding to an electrical lock signal.

17. A method of detecting tampering with a washing machine latch comprising the steps of:

attaching a bolt and a corresponding latch for receiving the bolt on an appliance door and appliance frame;

positioning a first magnet within the bolt;

inserting the bolt in the latch to repel a second magnet positioned on a movable element within the latch to be moved in response to proximity of the first magnet only when the bolt is received the latch;

detecting movement of the movable element to providing a lid switch signal indicating proper engagement of the bolt and latch; and capturing the bolt in the latch by means of a lock element responding to an electrical lock signal wherein the lock element is a slidable trap capturing an end of the bolt and further including the step of moving the trap from a first bolt-releasing position to a second, bolt-retaining position by a force of the engagement of the bolt with the latch.

18. The method of claim 17 wherein the trap is held in the second, bolt-retaining position by an insertion of a blocking element into the trap by a bi-stable actuator preventing sliding of the trap.

19. The method of claim 18 wherein motion of the bolt to disengage the bolt from the latch when the blocking element is received by the trap causes an abutting of the blocking element against a frangible portion of the trap and further including the step of breaking a frangible portion of the trap abutting the blocking element when the bolt is forcibly removed from the latch to provide a signal indicating damage to the latch.

20. The method of claim 19 wherein the frangible portion of the trap supports a spring element away from an opening into which the blocking element may he received such that removal of the frangible element causes the spring element to occlude the opening.

21. A wire protector for use with split loom tubing of a type providing a cylindrical lumen having alternating circumferential ridges, of relatively greater radius, and troughs, of relatively lesser radius, the wire protector comprising:

a first and second shell interlocking along an engagement axis to provide a conduit having a first and second communicating opening;

a series of teeth extending inwardly to the conduit parallel to the axis from the first shell proximate to the first opening, the teeth adapted to engage the troughs of the split loom tube when the split loom tube is placed in the conduit and extending from the first opening; and a bushing at the second opening for engagement with a hole in a panel.

* * * * *